US006276457B1

(12) United States Patent
Moffatt et al.

(10) Patent No.: US 6,276,457 B1
(45) Date of Patent: Aug. 21, 2001

(54) METHOD FOR EMPLACING A COIL TUBING STRING IN A WELL

(75) Inventors: Terrence George Moffatt, Cochrane; Ivan G. Mombourquette, Beaumont; Harbir Singh Chhina, Calgary, all of (CA)

(73) Assignees: Alberta Energy Company LTD; Promore Engineering Inc., both of Calgary (CA)

( * ) Notice: Subject to any disclaimer, the term of this patent is extended or adjusted under 35 U.S.C. 154(b) by 0 days.

(21) Appl. No.: 09/545,518

(22) Filed: Apr. 7, 2000

(51) Int. Cl.[7] ..... E21B 19/22; E21B 19/20
(52) U.S. Cl. ..... 166/381; 166/376; 166/77.1
(58) Field of Search ..... 166/376, 377, 166/378, 380, 381, 382, 50, 77.1

(56) References Cited

U.S. PATENT DOCUMENTS 4,523,645 * 6/1985 Moore ..... 166/385
4,585,066 * 4/1986 Moore et al. ..... 166/385
4,597,440 * 7/1986 Pottier ..... 166/250
4,945,995 * 8/1990 Tholance et al. ..... 166/375
5,318,129 * 6/1994 Wittrisch ..... 166/336
5,709,269 1/1998 Head .

* cited by examiner

*Primary Examiner*—Frank S. Tsay
(74) *Attorney, Agent, or Firm*—Millen, White, Zelano & Branigan, P.C.

(57) ABSTRACT

The bottom end of a coil tubing string is secured to the bottom end of a primary tubing string at ground surface. Usually the primary tubing string will be of larger diameter and is therefore stronger and stiffer than the coil tubing string. The strings are secured together with a locking assembly. This assembly comprises two interlocking members, one connected with each string. One of the interlocking members is meltable when exposed to elevated temperature. The primary tubing string and the coil tubing string are run together into the desired position in the wellbore. The primary tubing string acts to drag the coil tubing string along with it. Heat is then used to melt the interlocking member so that the strings can be separated. The heat can be provided by circulating steam or hot water or oil down to the assembly. Alternatively the downhole formation temperature may be sufficient to induce melting. Once separated, each string can be pulled or moved independently.

4 Claims, 2 Drawing Sheets

METHOD FOR EMPLACING A COIL TUBING STRING IN A WELL

FIELD OF THE INVENTION

The present invention relates to a means and method for emplacing a string of coil tubing in a wellbore.

BACKGROUND OF THE INVENTION

It is common oilfield practice to emplace a string of coil tubing in a completed oil or gas wellbore. The coil tubing may be used for any of a variety of purposes. For example, it can be used for chemical injection; steam injection, service as a bubble tube for measuring downhole pressure, sand clean-out, solvent spotting or circulation, or for carrying sensor instrumentation for measuring downhole pressure or temperature. The present invention was developed in connection with using coil tubing for carrying sensor instrumentation downhole.

Coil tubing has a relatively small diameter. The diameter can vary between ⅛ inch and 2 inch. As a result, a string of coil tubing is pretty flexible. It has a tendency to spiral or corkscrew as it is being run into a wellbore. Also, it does not lend itself to being forced through wellbore tight spots, sand plugs and the like. These problems are magnified when trying to run the coil tubing in to the toe end of a horizontal wellbore, such as a wellbore to be used in a steam-assisted gravity drainage ("SAGD") project. (A horizontal wellbore usually extends downwardly from ground surface to a hydrocarbon-containing reservoir and then bends to extend, generally horizontally, into the reservoir. The wellbore is described as having a "heel" (at the bend) and a "toe" (at the far end of the wellbore). The section of wellbore between heel and toe is often referred to as the "production interval").

As previously indicated, it is known to emplace a coil tubing instrumentation string in the horizontal section of a wellbore to measure formation temperature or pressure and relay this information to ground surface through cable means. From this information, the operator can develop a temperature or pressure profile extending the length of the production interval. However this requires that the string extend from the heel to the toe of the horizontal wellbore section.

So one problem to be addressed is how to better insert a coil tubing string to the desired landing point in a wellbore. In the case of a wellbore having a horizontal production interval, the problem is how to better insert the string so that it reaches the toe end of the wellbore. However, the solution to the problem needs to ensure that, once the coil tubing string is in place downhole, it is present as a freely and independently movable string.

SUMMARY OF THE INVENTION

In accordance with the invention, there is provided a locking assembly comprising two interlocking members. One member is secured to the bottom end of a relatively large diameter and substantially rigid production or steam injection tubing string (hereinafter referred to as the "primary string"). The other member is secured to the bottom end of a relatively small diameter and more flexible coil tubing string. The locking assembly is used to secure the bottom ends of the two strings together at ground surface. The strings are then run into the wellbore together. The primary string functions to pull the coil tubing string along with it. The primary string is better able to penetrate through obstructions in the wellbore and reach the desired landing point. Thus the likelihood of landing the coil tubing string at the desired landing point is improved. In many cases the desired landing point is in the toe end of a horizontal wellbore.

One of the interlocking members is formed of a material which melts when exposed downhole to an elevated temperature for sufficient time. The elevated temperature can be provided by circulating a hot fluid, such as steam, into the vicinity of the shear sub. Alternatively, the reservoir itself may be at a temperature sufficient to cause melting.

In either case, once the shear sub is landed downhole and exposed to elevated temperature for sufficient time to melt the meltable member, the two strings can then be separated.

The invention gives the well operator the opportunity to pull either string independently after deployment and separation. If the coil tubing string is an instrumentation coil tubing string, it can be independently removed for repairs or for transfer to another well. If the primary string needs to be removed or landed at another point along the wellbore, without moving the secondary string, this is now feasible.

In one aspect, the invention is a method for emplacing a coil tubing string having a bottom end in a wellbore having a horizontal section, said section having toe and heel ends, comprising providing at ground surface a primary tubing string and a coil tubing string, each having a bottom end, the primary tubing string having a larger diameter and being stronger and more rigid than the coil tubing string; securing the coil tubing string bottom end to primary tubing string bottom end with first means secured to one string bottom end and second means secured to the other string bottom end, said first and second means being interlocked by a pair of solid members, one of which is meltable at downhole elevated temperature; running the two strings into the borehole with the coil tubing string secured to the primary tubing string and landing their bottom ends adjacent the toe end of the wellbore; melting the meltable member; and separating the coil tubing string from the primary tubing string.

In another aspect, the invention is an assembly for running into a wellbore, comprising a coil tubing string having a bottom end; a tubing string having a bottom end; the primary tubing string having a larger diameter than the coil tubing string; and a locking assembly securing the two bottom ends together, said assembly comprising first means secured to one string bottom end and second means secured to the other string bottom end, said first and second means being interlocked by a pair of solid members, one of the members being convertible from a solid form to a liquid form when exposed to a liquefying agent.

DESCRIPTION OF THE PREFERRED EMBODIMENT

Figure 1:
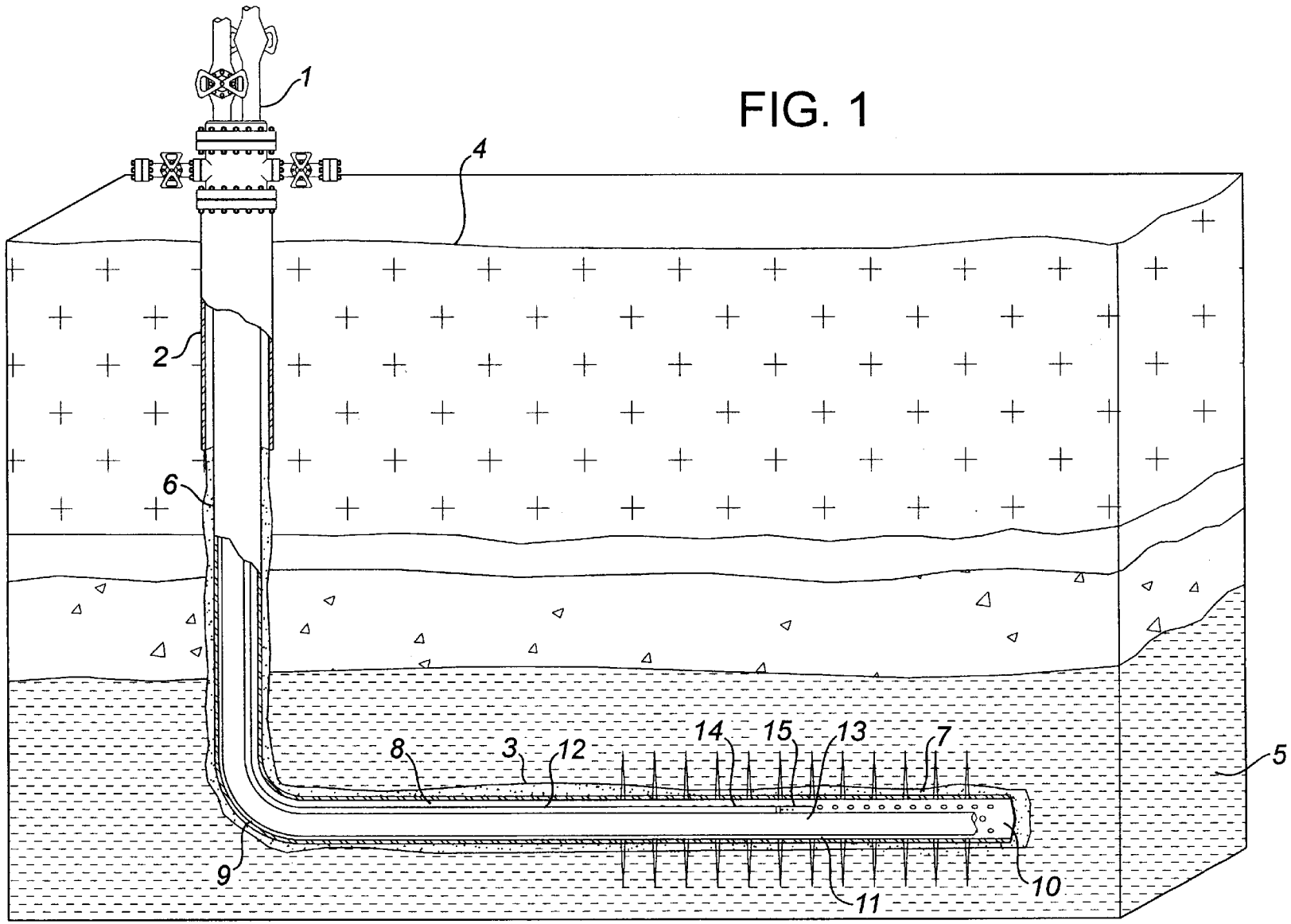
FIG. 1 is a schematic showing a horizontal wellbore having a primary tubing string and a string of coiled tubing positioned therein and landed adjacent the toe end of the wellbore, the two strings being secured together at their bottom ends by a locking assembly.
Figure 2:
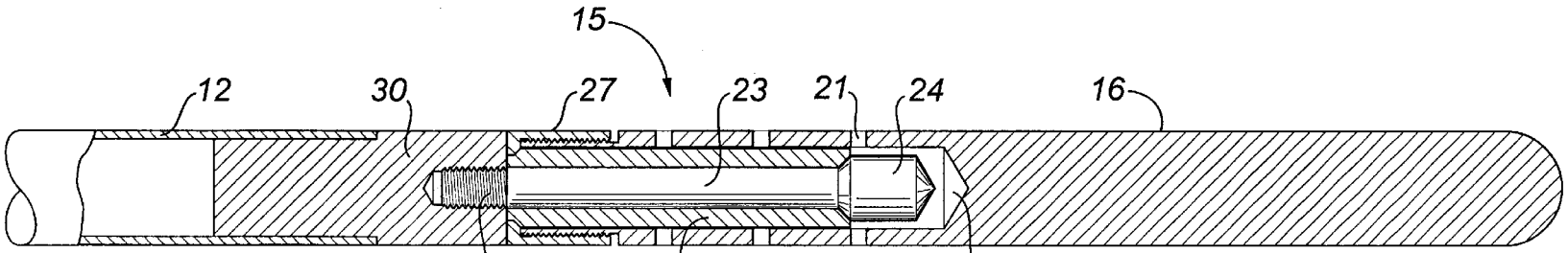
FIG. 2 is a plan sectional view showing the locking assembly.
Figure 3:
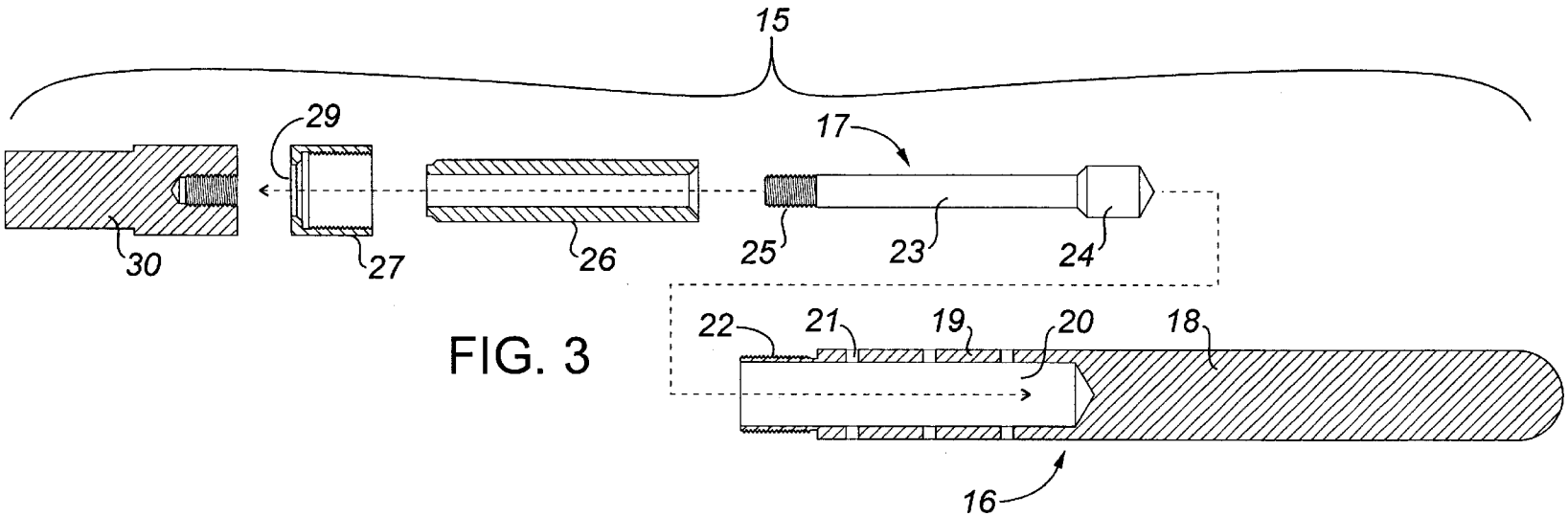
FIG. 3 is an exploded plan view, partly in section, of the locking assembly of FIG. 2.

FIG. 1 shows a horizontal well 1, having riser and horizontal sections 2, 3, extending from ground surface 4 and penetrating a hydrocarbon-containing reservoir 5. The well 1 is completed with casing 6 and a perforated production liner 7. A wellbore 8 is formed by the casing and liner. The wellbore 8 has heel and toe ends 9, 10. A primary tubing string 11, such as a production or steam injection tubing string, is positioned in the wellbore 8 at its toe end 10. A substantially co-extensive string 12 of coil tubing is positioned beside the primary tubing string 11. The bottom ends 13, 14 of the strings 11, 12 are secured together by a locking assembly 15.

The locking assembly 15 comprises a shear sub 16, which is welded to the outer surface of the primary tubing string 11, and a separable assembly 17 which is threadably connected with the coil tubing string 12. The shear sub 16 and separable assembly 17 interlock, as described below, to secure the two strings 11, 12 together.

More particularly, the shear sub 16 is an elongated cylindrical steel body 18 having a tubular rear end side wall 19 forming an axial chamber 20, open at its rear end. The side wall 19 has perforations 21 and terminates with a threaded segment 22.

The assembly 17 comprises a steel shaft 23 having an expanded diameter head 24 at its front end and a threaded rear end 25. The shaft 23 is received in the axial chamber 20 of the first member 16 and its rear end 25 protrudes therefrom. A tubular plastic sleeve 26 is positioned concentrically around the shaft 23 and abuts the head 24. An internally threaded cap 27 is screwed onto the threaded segment 22 of the shear sub 16. The end wall 28 of the cap 27 forms a central opening 29 through which the rear end 25 of the shaft 23 protrudes. The cap end wall opening 29 is sized to allow the shaft 23 and head 24 to pass therethrough, but not the solid sleeve 26. The shaft rear end 25 is threaded into a coupling 30 which threadably connects with the coil tubing string 12.

From the foregoing it will be understood that the sleeve 26 and cap end wall 28 provide two interlocking members, tieing together means secured to the primary tubing string 11 and means secured to the coil tubing string 12. One of these interlocking members is readily meltable at downhole elevated temperature.

The plastic selected for the shear sleeve 30 should be strong enough to withstand the compressive loading that one would anticipate would occur as the primary tubing string 11 drags the coil tubing string 12 along through the wellbore 8. It should also melt when subjected to the expected downhole elevated temperature. An appropriate selection of the plastic or other suitable material can be made without difficulty by one of ordinary skill in the art. By way of example, for a steam injection well having a depth of 500 meters we selected a plastic available from Plasti Fab Industries, Alberta, under the designation low-density polyethylene, having a compressive strength of 4000 psi and a melting temperature of 95° C.

When so melted, the plastic can drain out of the chamber 17 through the side openings 20 and the coil tubing string 11 can be pulled a short distance to separate the assembly 17 from the shear sub 16.

In the practise of the invention, the bottom ends 13, 14 of the primary and coil tubing strings 11, 12 are secured together at ground surface with the locking assembly 15. This may be done by assembling the assembly 17, shear sub 16, threadably connecting the coupling 30 to the bottom end 14 of the coil tubing string 12 and welding the body 18 to the bottom end 13 of the primary string 11. The two strings are then run together into the wellbore 8 and landed in the toe end 10. Steam is introduced into the toe end of the wellbore, to melt the shear sleeve 26. The coil tubing string 12 can then be moved to withdraw the shaft 23 and head 24 from the axial chamber 20 and separate or disconnect the two strings.

The invention has been described in the context of using heat downhole to melt one of the solid interlocking members of the locking assembly 15. However it is within the scope of the invention to form one of the interlocking members of a solid material convertible to a liquid form when exposed to a liquefying agent such as a solvent.

The Embodiments of the invention in which an exclusive property of privilege is claimed are defined as follows:

1. A method for emplacing a coil tubing string having a bottom end in a wellbore having a horizontal section, said section having toe and heel ends, comprising:

providing at ground surface a primary tubing string and a coil tubing string, each having a bottom end, the primary tubing string having a larger diameter and being stronger and more rigid than the coil tubing string;

securing the coil tubing string bottom end to the primary tubing string bottom end with first means secured to one string bottom end and second means secured to the other string bottom end, said first and second means being interlocked by a pair of solid members, one of which is meltable at downhole elevated temperature;

running the two strings into the borehole with the coil tubing string secured to the primary tubing string and landing their bottom ends adjacent the toe end of the wellbore;

melting the meltable member; and separating the coil tubing string from the primary tubing string.

2. The method as set forth in claim 1 comprising:

circulating or injecting steam in or through the horizontal section of the wellbore to create an elevated temperature in said section sufficient to melt the meltable member.

3. An assembly for running into a wellbore, comprising:

a coil tubing string having a bottom end;

a primary tubing string having a bottom end;

the primary tubing string having a larger diameter than the coil tubing string; and a locking assembly securing the two bottom ends together, said assembly comprising first means secured to one string bottom end and second means secured to the other string bottom end, said first and second means being interlocked by a pair of solid members, one of the members being convertible from a solid form to a liquid form when exposed to a liquefying agent.

4. The assembly as set forth in claim 2 wherein the convertible member is meltable when exposed to downhole steam.

* * * * *